US005397594A

United States Patent [19]

Koyabu et al.

[11] Patent Number: 5,397,594

[45] Date of Patent: Mar. 14, 1995

[54] PROCESS FOR PRODUCING HEAT-SENSITIVE RECORDING MATERIAL

[75] Inventors: Kyoko Koyabu; Yasuyoshi Morita, both of Tokyo, Japan

[73] Assignee: New Oji Paper Co., Ltd., Tokyo, Japan

[21] Appl. No.: 655,593

[22] Filed: Feb. 15, 1991

[30] Foreign Application Priority Data

Feb. 19, 1990 [JP] Japan ..... 2-36112
Mar. 6, 1990 [JP] Japan ..... 2-52792

[51] Int. Cl.[6] ..... B41M 3/12

[52] U.S. Cl. ..... 427/150; 427/151; 427/385.5

[58] Field of Search ..... 427/150, 151, 385.5

[56] References Cited

U.S. PATENT DOCUMENTS 4,246,312 1/1981 Kosaka et al. ..... 427/151
4,247,595 1/1981 Nomura et al. ..... 427/151
4,407,886 10/1983 Hoffman et al. ..... 427/151
4,527,178 7/1985 Usui et al. ..... 427/151
4,554,566 11/1985 Yoneda et al. ..... 427/151
4,717,593 1/1988 Igarashi et al. ..... 427/150

FOREIGN PATENT DOCUMENTS 56-15394 2/1981 Japan .
58-76293 5/1983 Japan .

*Primary Examiner*—Janyce Bell
*Attorney, Agent, or Firm*—Armstrong, Westerman, Hattori, McLeland & Naughton

[57] ABSTRACT

A heat-sensitive recording material with a satisfactory whiteness and an enhanced heat-sensitivity is produced by a process comprising the steps of preparing a coating liquid containing a dye-precursor dispersion and a color developer dispersion, coating a surface of a sheet substrate with the coating liquid and solidifying the resultant coating liquid layer on the sheet substrate, in which process at least one member of the dye-precursor and the color developer is finely pulverized by at least one dispersing operation, in the presence of a pulverizing medium consisting of a number of solid grains having a diameter of 0.9 mm or less, into fine particles having an average size of 0.7 μm or less.

7 Claims, No Drawings

PROCESS FOR PRODUCING HEAT-SENSITIVE RECORDING MATERIAL

BACKGROUND OF THE INVENTION

1) Field of the Invention

The present invention relates to a process for producing a heat-sensitive recording material. More particularly, the present invention relates to a process for producing a satisfactory whiteness and an enhanced heat-sensitivity.

2) Description of the Related Arts

A heat-sensitive recording system is advantageous in that colored images can be recorded on a recording material by only a heating operation and the recording apparatus is relatively simple and compact. Accordingly, this heat-sensitive recording system is widely utilized for various information-recording systems.

Particularly, due to recent extensive developments in facsimile systems in which a heat-sensitive recording printer is utilized, it has become possible to provide a high recording speed impossible to obtain from a conventional recording system.

Accordingly, there is a strong demand for the provision of a heat-sensitive recording material having an enhanced record sensitivity and usable for a high speed recording machine.

Many attempts have been made to meet this demand, and usually, the heat-sensitive recording material comprises a substrate composed of a paper sheet, plastic film or synthetic paper sheet, and at least one heat-sensitive recording layer comprising, as a principal component, a heat-sensitive color-forming material and a resinous binder and formed on the substrate.

It is known that the recording sensitivity of the heat-sensitive recording material can be enhanced by:

1) adding a heat-fusible substance having a low melting point to the heat-sensitive recording layer,
2) increasing the surface smoothness of the heat-sensitive recording layer, and
3) increasing the content of the color-forming material in the heat-sensitive recording layer.

Nevertheless, the above-mentioned approaches are disadvantageous in that an undesirable adhesion of the heat-fusible component in the heat-sensitive recording layer to a thermal head in the printer occurs, and this adhesion causes a formation of unclear images on the recorded material.

Many attempts have been made to remove the above-mentioned disadvantages, and it has been found that a fine pulverization of the heat-sensitive color-forming material particles effectively enhances the recording sensitivity of the heat-sensitive recording layer without increasing the content of the color-forming material in the recording layer.

For example, Japanese Unexamined Patent Publication Nos. 58-69089 and 58-76293 disclose a process for finely pulverizing the heat-sensitive color-forming material.

It is commonly believed that, in a heat-sensitive recording layer having a high recording sensitivity, the heat-sensitive color-forming material must be in the form of fine particles having an average particle size of 0.7 μm or less, but it is very difficult to attain the fine pulverization of the heat-sensitive color-forming material as long as the pulverization is carried out by using a dispersing medium consisting of solid grains having a diameter of 1.0 mm or more.

SUMMARY OF THE INVENTION

An object of the present invention is to provide a process for producing a heat-sensitive recording material having a high recording sensitivity, with a high efficiency.

Another object of the present invention is to provide a process for producing a heat-sensitive recording material containing a very finely pulverized dye-precursor and/or color developer having an average particle size of 0.7 μm or less.

The above-mentioned objects can be attained by the process of the present invention for producing a heat-sensitive recording material, which comprises the steps of dispersing at least one substantially colorless electron-donating dye-precursor in water to prepare an aqueous dye-precursor dispersion; separately dispersing at least one electron-accepting compound capable of a contact-reaction with and color-development of the dye-precursor upon being heated, in water to provide an aqueous color-developer dispersion; preparing a coating liquid containing the aqueous dye-precursor dispersion and the aqueous color-developer dispersion; coating at least one surface of a sheet substrate with the coating liquid; and solidifying the resultant coating liquid layer to form a heat-sensitive recording layer on the sheet substrate, wherein at least one member of the dye-precursor and the color developer is finely pulverized by at least one dispersing operation, in the presence of a pulverizing medium consisting of a number of solid grains having a diameter of 0.9 mm or less, into fine particles having an average particle size of 0.7 μm or less.

In an embodiment of the process of the present invention, at least one additional dispersing operation is carried out by using a pulverizing medium consisting of a number of solid grains having a diameter of 1.0 mm or more, in addition to the at least one dispersing operation using the pulverizing medium consisting of a number of the solid grains having the diameter of 0.9 mm or less; the order of the above-mentioned dispersing and additional dispersing operations being carried out as required.

In another embodiment of the process of the present invention, the resultant dye-precursor dispersion passed through the dispersing operation, using the pulverizing medium consisting of a number of the solid particles having the diameter of 0.9 mm or less, is discharged at a temperature of 30° C. to 60° C. from the dispersing operation.

DESCRIPTION OF THE PREFERRED EMBODIMENTS

It was found, for the first time by the inventors of the present invention, that fine particles of a dye-precursor or color developer having an average size of 0.7 μm or less and evenly dispersed in an aqueous medium can be prepared by using a pulverizing medium consisting of a number of solid grains having a diameter of 0.9 μm or less in at least one dispersing operation.

In a conventional dispersing operation, the solid grains for the pulverizing medium have a diameter of 1.0 mm or more. When the conventional pulverizing solid grains having a diameter of 100 mm or more are replaced by small pulverizing solid grains having a diameter of 0.9 mm or less, the number of the pulverizing solid grains contained in a unit volume is greatly increased, and thus in a dispersing operation, the number of contacts of the particles of the dye-precursor or color developer to be pulverized with the pulverizing solid grains in a unit time is also greatly increased. Therefore, the dye-precursor or color developer particles to be pulverized can be finely pulverized at an increased pulverizing rate to form fine particles having a uniform size.

In the process of the present invention, the pulverizing medium preferably comprises at least one member selected from the group consisting of glass beads, zirconia beads, alumina beads, silica beads, ceramic beads, steel beads and titanium beads.

Preferably, the pulverizing solid grains have a specific gravity of 2 to 7 g/cm$^3$. When the specific gravity is less than 2 g/cm$^3$, the resultant pulverizing solid grains exhibit a lower shearing force to be applied to the dye-precursor or color-developer, which causes an unsatisfactory pulverizing capability. Also, if the specific gravity is more than 7 g/cm$^3$, the resultant pulverizing solid grains exhibit a lesser fluidability, which leads to an unsatisfactory pulverizing capability.

Usually, the dispersing operations for the dye-precursor and the color developer are carried out by using a sand grinder, atomizer or ball mill. The sand grinders can be selected from horizontal sand grinders and vertical sand grinder, but is preferably a horizontal sand grinder.

There is no limitation of the type of the dispersing machines and pulverizing medium-separating system for the dispersing machine.

Namely, the dispersing machine can be selected from the horizontal type, vertical type and inclined type of dispersing machines. Also, the pulverizing medium-separating system through which the resultant dispersion is separated from the pulverizing medium, can be chosen from slit type, screen type and gap type separating devices.

The finely pulverized dye-precursor or color developer particles produced in accordance with the process of the present invention usually have a particle size of from 0.05 to 2.0 μm.

The finely pulverized dye-precursor or color developer particles have an average particle size of 0.7 μm or less, preferably 0.1 to 0.7 μm.

Preferably, in the resultant finely pulverized dye-precursor or color developer particles, the amount of a fraction thereof consisting of particles having a size of 1 μm or less is 70% or more based on the total weight of all of the particles.

In the process of the present invention, at least one additional dispersing operation is optionally carried out by using a pulverizing medium consisting of a number of relatively large solid grains having a diameter of 1.0 mm or more, before or after the dispersing operation using the pulverizing solid grains with a diameter of 0.9 mm or less.

In this additional dispersing operation, each of the large pulverizing solid grains with a diameter of 1.0 mm or more moves with a larger moving energy than that of each of the small pulverizing solid grains with the diameter of 0.9 mm or less. Therefore, the shearing force of the large pulverizing solid grains is larger than that of the small pulverizing solid grains, and thus effectively divides coarse particles of the dye-precursor or color developer.

Preferably, in the resultant finely pulverized particles of the dye-precursor or color developer, the amount of a fraction thereof consisting of particles having a size of 2 μm or more is 10% or less based on the total weight of all of the particles.

In the preparation of the aqueous dye-precursor dispersion by using the pulverizing medium consisting of a number of solid grains with a diameter of 0.9 mm or less, the resultant aqueous dye-precursor dispersion sometimes has a reduced whiteness.

During the dispersing operation, the pulverized particles of the dye-precursor have newly formed surfaces which exhibit a high reactivity, and therefore, a portion of the dye-precursory particles becomes color-developed on the newly formed surfaces thereof.

Especially, the fine pulverization of the dye-precursor into a particle size of 0.7 μm or less sometimes promotes the color development of the finely pulverized dye-precursor particles, and therefore, the whiteness of the resultant aqueous dye-precursor dispersion is reduced.

The inventors of the present invention found, for the first time, that the reduction in the whiteness of the aqueous dye-precursor dispersion can be prevented by controlling the temperature of the resultant dye-precursor dispersion to a level of 30° C. to 60° C. when discharging the dispersion from the dispersing operation using the pulverizing medium consisting of a number of solid grains with a diameter of 0.9 mm or less.

When the dispersing step for the dye-precursor includes at least one dispersing operation using the small pulverizing solid grains with the diameter of 0.9 mm or less and at least one additional dispersing operation using the large pulverizing solid grains with the diameter of 1.0 mm or less, the resultant dye-precursor dispersion is preferably discharged at a temperature of 30° C. to 60° C. from the dispersing step.

When the discharging temperature is less than 30° C., the prevention of the color development of the dye-precursor particles is unsatisfactory. If the discharging temperature is more than 60° C., the pulverized particles are undesirably agglomerated in the dispersion thereof, or the resultant dye-precursory dispersion exhibits an undesirably increased viscosity.

In the process of the present invention, the coating liquid contains an aqueous dye-precursor dispersion and an aqueous color developer dispersion.

The dye-precursor comprises at least one member selected from substantially colorless, electron-donating dye precursors. Also, the color developer comprises at least one member selected from electron-accepting compounds capable of a contact-reaction with and color development of the dye-precursor when heated.

The dispersing operation for the dye-precursor or the color developer is carried out in an aqueous medium, usually an aqueous solution of a resinous binder comprising a water-soluble polymeric material.

For example, the water-soluble polymeric material comprises at least one member selected from water-soluble synthetic polymeric compounds, for example, polyacrylamide, polyvinyl pyrrolidone, polyvinyl alcohol, and styrene-maleic anhydride copolymer resins, and water-soluble natural polymeric compounds and derivatives thereof, for example, hydroxyethylcellulose, starch derivatives, gelatin and casein.

In the aqueous dye-precursor or color developer dispersion, preferably the water soluble resinous binder is contained in a content of 1 to 20% by weight, more preferably 3 to 10% by weight.

The dye-precursor usable for the present invention can be selected from those usable for conventional heat-sensitive recording materials and pressure-sensitive recording materials.

For example, the dye precursor comprises at least one member selected from:

(1) triacrylmethane compounds, for example, 3,3'-bis(p-dimethylaminophenyl)-6-dimethylaminophthalide;

(2) diphenylmethane compounds, for example, 4,4'-bis-dimethylaminobenzhydrinbenzylether, N-2,4,5-trichlorophenylleucoauramine, and N-2,4,5-trichlorophenylleucoauramine; and (3) xanthene compounds, for example, rhodamine B-anilinolactam, 3-diethylamino-7-dibenzylaminofluoran, 3-diethylamino-7-butylaminofluoran, 3-diethylamino-7-(2-chloroanilino)fluoran, 3-piperidino-6-methyl-7-anilinofluoran, 3-ethyltriamino-6-methyl-7-anilinofluoran, 3-cyclohexylmethylamino-6-methyl-7-anilinofluoran, 3-diethylamino-6-chloro-7-(β-ethoxyethyl)aminofluoran, 3-diethylamino-6-chloro-7-(γ-chloropropyl)aminofluoran, 3-ethyl-isoamylamino-6-methyl-7-anilinofluoran and 3-dibutylamino-7-chloroanilinofluoran.

The dye-precursor compounds can be selected in consideration of the use of the heat-sensitive recording material and the properties required for the recording material.

The color developer usable for the present invention preferably comprises at least one electron-accepting compound selected from phenol compounds aromatic carboxylic acid compounds, more preferably selected from the phenol compounds.

For example, the color developing compound is selected from (1) phenol compounds, for example, p-octylphenol, p-tert-butylphenol, p-phenylphenol, 1,1-bis(p-hydroxyphenyl)propane, 2,2-bis(p-hydroxyphenyl)pentane, 1,1-bis(p-hydroxyphenyl)hexane, 2,2-bis(p-hydroxyphenyl)hexane, 1,1-bis(p-hydroxyphenyl)-2-ethylhexane, 2,2-bis(4-hydroxy-3,5-dichlorophenyl)propane and dihydroxydiphenylether, and (2) aromatic carboxylic acid compounds, for example, p-hydroxybenzoic acid, butyl p-hydroxybenzoate, 3,5-di-tert-butyl salicylic acid, 3,5-di-α-methylbenzylsalicylic acid and multivalent metal salts of the above-mentioned acid compounds.

In the process of the present invention, the coating liquid optionally contains an additive comprising at least one member selected from, for example, sensitizing agents, inorganic pigments, wax materials, metal salts, ultraviolet ray-absorbers, antioxidants, latex binders, surfactants and anti-foaming agents, as long as the additive does not affect the property of the resultant heat-sensitive recording material.

The additive can be present in the aqueous dye-precursor dispersion and/or the aqueous color developer dispersion or can be mixed with the aqueous dye-precursor and color developer dispersions when the coating liquid is prepared.

The heat-sensitive recording layer optionally contains 5 to 30% by weight of a wax material comprising at least one member selected from, for example, paraffin waxes, carnauba wax, microcrystalline waxes, polyethylene waxes, higher fatty acid amide waxes, for example, stearic acid amide, ethylene-bis-stearoamide and higher fatty acid esters.

The metal salt can be contained in an amount of 5 to 20% by weight in the heat-sensitive recording layer. The metal salt is preferably selected from multivalent metal salts of higher fatty acids, for example, zinc stearate, aluminum stearate, calcium stearate and zinc oleate.

The inorganic pigment is optionally contained in an amount of 20 to 50% by weight in the heat-sensitive recording layer and is preferably selected from kaolin, sintered kaolin, talc, agalmatolite, diatomaceous earth, calcium carbonate, aluminum hydroxide, magnesium hydroxide, magnesia, titanium dioxide and barium carbonate.

The sensitizing agent is optionally contained in an amount of 10 to 30% in the heat-sensitive recording layer and is preferably selected from p-benzylbiphenyl, dibenzyl terephthalate, phenyl 1-hydroxy-2-naphthoate, dibenzyl oxalate, di-o-chlorobenzyl adipate, 1,2-di(3-methylphenoxy)ethane and di-p-chlorobenzyl oxalate.

The coating liquid contains a resinous binder in addition to the dye-precursor, the color developer and the additive.

The resinous binder usually comprises at least one water-soluble polymeric material, selected from, for example, polyvinyl alcohol, hydroxyethylcellulose, hydroxypropylcellulose, ethylene-maleic anhydride copolymer, styrene-maleic anhydride copolymer, isobutylene-maleic anhydride copolymer, polyacrylic acid, polymethacrylic acid, starch, casein and gelatin.

The resinous binder optionally contains an additional resinous material for imparting a water-resistance to the heat-sensitive recording layer.

The additional resinous material can be selected from aqueous emulsions of hydrophobic resins, for example, styrene-butadiene rubber latexes and acrylic ester resin emulsions.

The coating liquid is applied to at least one surface of the sheet substrate and the resultant coating liquid layer is solidified by drying to form a heat-sensitive recording layer in a dry solid weight of 3 to 8 g/m$^2$ on the sheet substrate.

The application of the coating liquid can be any conventional coating method, for example, air-knife coating method, blade coating method, gravure coating method, roll coating method, spraying method, dipping method, bar coating method or extrusion coating method.

The sheet substrate usable for the present invention is not limited to a specific group of materials. Usually, the sheet substrate comprises a paper sheet, synthetic paper sheet or synthetic plastic film or sheet.

EXAMPLES

The present invention will be further explained by the following specific examples.

Example 1

A coating liquid for a heat-sensitive recording layer was prepared in the following manner.

(1) Preparation of an aqueous dye-precursor dispersion having the following composition

| Component | Part by weight |
|---|---|
| 3-(N-ethyl-N-isoamylamino)- | 10 |

-continued

| Component | Part by weight |
|---|---|
| 6-methyl-7-anilinofluoran | |
| 10% aqueous solution of polyvinyl alcohol (molecular weight: 500 and degree of saponification: 90%) | 30 |
| Water | 60 |

The composition was placed in a horizontal sand mill (available under the trademark of ULTRAVISCOMILL, from Igarashi Kikai Seizo K.K.) and dispersed therein in the presence of a pulverizing medium consisting of a number of glass beads having a diameter of 0.6 mm for 60 minutes, while cooling the mill by circulating a cooling water at a temperature of 5° C. through a juckel surrounding the sand mill, to control the temperature of the outlet portion of the sand mill to a level of 20° C. to 25° C.

(2) Preparation of an aqueous color developer dispersion having the following composition.

| Component | Part by weight |
|---|---|
| 2,2-bis(p-hydroxyphenyl)propane | 10 |
| p-benzylbiphenyl 10% aqueous solution of polyvinyl alcohol (molecular weight: 500, degree of saponification: 90%) | 10 |
| Water | 70 |

The composition was dispersed by the same dispersing operation as mentioned above.

(3) Preparation of heat-sensitive record layer-coating liquid

A coating liquid was prepared by mixing 100 parts by weight of the aqueous dye-precursor dispersion with 100 parts by weight of the aqueous color developer dispersion, 40 parts by weight of calcium carbonate, and 100 parts by weight of a 10% aqueous solution of a polyvinyl alcohol, while stirring.

A front surface of a sheet substrate consisting of a paper sheet with a basis weight of 50 g/m$^2$ was coated with the coating layer and the resultant coating liquid layer was dried to form a heat-sensitive recording layer with a dry solid weight of 7.5 g/m$^2$, whereby a heat-sensitive recording sheet was obtained.

In each of the dispersing steps for the aqueous dye-precursor dispersion and the aqueous color developer dispersion, the size of the finely pulverized particles was measured and the content of a fraction consisting of coarse particles with a size of 2 μm or more in the resultant dispersion was determined.

Also, the recording sensitivity and whiteness of the resultant heat-sensitive recording sheet were measured in the following manner.

The particle sizes were measured by using a particle size tester, available under the trademark of TESTER LPA-3000/3100, from OTSUKA DENSHI K.K.

The recording sensitivity was measured by using a printing tester produced by modifying a practical heat-sensitive facsimile printing machine. In this printing test, a number of letter images were printed on 64 lines at a one line recording time of 10 mm.second and a scanning line density of 8×8 dots/mm, while changing a pulse width and varying the printing energy per dot from 0.24 mJ to 0.39 mJ. The color darkness of the printed images was measured by a color darkness tester available under the trademark of MACBETH DARKNESS TESTER RD-914, from Kollmorgen Co. The recording sensitivity of the recording sheet was represented by the measured value of the color darkness.

The whiteness was measured by using a whiteness tester available under a trademark of HUNTER REFLECTOMETER from Tokyo Seiki Seisakusho.

The test results are shown in Table 1.

Example 2

The same procedures as in Example 1 were carried out except that, in the preparation of the aqueous dye-precursor dispersion, the glass beads having the diameter of 0.6 mm were replaced by glass beads having a diameter of 1.2 mm, whereas the aqueous color developer dispersion was prepared by using the glass beads having the diameter of 0.6 mm.

The test results are shown in Table 1.

Example 3

The same procedures as in Example 1 were carried out except that, in the preparation of the aqueous color dispersion, the glass beads having the diameter of 0.6 mm were replaced by glass beads having a diameter of 1.2 mm, whereas in the preparation of the aqueous dye-precursor dispersion, the glass beads having the diameter of 0.6 mm were employed.

The test results are shown in Table 1.

Example 4

The same procedures as in Example 1 were carried out except that, in the preparation of the aqueous dye-precursor and color developer dispersions, the glass beads having the diameter of 0.6 mm were replaced by zirconia beads having a diameter of 0.6 mm.

The test results are shown in Table 1.

Example 5

The same procedures as in Example 1 were carried out except that, in the preparation of each of the aqueous dye-precursor and color developer dispersions, the horizontal sand mill was replaced by a vertical sand mill available under the trademark of DIAMOND FINE MILL from Mitsubishi Heavy Industries Co.

The test results are indicated in Table 1.

Example 6

The same procedures as in Example 1 were carried out except that, in the preparation of each of the aqueous dye-precursor and color developer dispersions, the dispersing operation by using the glass beads having a diameter of 0.6 mm for 60 minutes was replaced by an additional dispersing operation by using glass beads having a diameter of 1.2 mm for 30 minutes and then subjected to a dispersing operation using glass beads having a diameter of 0.6 mm, for 30 minutes.

The test results are indicated in Table 1.

Example 7

The same procedures as in Example 1 were carried out except that, in the preparation of each of the aqueous dye-precursor and color developer dispersions, the dispersing operation by using the glass beads having the diameter of 0.6 mm for 60 minutes was replaced by a dispersing operation by using glass beads having a diameter of 0.6 mm for 30 minutes, and then subjected to an additional dispersing operation using glass beads having a diameter of 1.2 mm, for 30 minutes.

The test results are shown in Table 1.

Example 8

The same procedures as in Example 1 were carried out except that in the preparation of the aqueous dye-precursor dispersion, the temperature of the cooling water for the sand mill was changed from 5° C. to 20° C. and the temperature of the outlet portion of the sand mill was controlled to a level of from 40° C. to 45° C.

The test results are indicated in Table 1.

Comparative Example 1

The same procedures as in Example 1 were carried out except that in the preparation of the aqueous dye-precursor and color developer dispersions, the pulverizing media used consisted of glass beads having a diameter of 1.2 mm in place of those of 0.6 mm.

The test results are indicated in Table 1.

Comparative Example 2

The same procedures as in Example 1 were carried out except that, in the preparation of each of the aqueous dye-precursor and color developer dispersions, the pulverizing glass beads with the diameter of 0.6 mm were replaced by pulverizing glass beads with a diameter of 1.2 mm and the dispersing time was changed from 60 minutes to 120 minutes.

The test results are indicated in Table 1.

Comparative Example 3

The same procedures as in Example 4 were carried out except that, in the preparation of each of the aqueous dye-precursor and color developer dispersions, the pulverizing zirconia beads with the diameter of 0.6 mm were replaced by pulverizing zirconia beads with a diameter of 1.2 mm.

Comparative Example 4

The same procedures as mentioned in Example 5 were carried out, except that in the preparation of each of the aqueous dye-precursor and color developer dispersions, the pulverizing glass beads with the diameter of 0.6 mm were replaced by pulverizing glass beads with a diameter of 1.2 mm.

The test results are indicated in Table 1.

Comparative Example 5

The same procedures as mentioned in Example 5 were carried out, except that each of the aqueous dye-precursor and color developer dispersions was prepared by a dispersing operation using pulverizing glass beads with a diameter of 1.2 mm for 30 minutes and then a dispersing operation using pulverizing glass beads with a diameter of 1.5 mm for 30 minutes.

The test results are shown in Table 1.

Comparative Example 6

The same procedures as described in Example 7 were carried out, except that each of the aqueous dye-precursor and color developer dispersions was prepared by a dispersing operation using pulverizing glass beads with a diameter of 1.5 mm for 30 minutes, and by a dispersing operation using pulverizing glass beads with a diameter of 1.2 mm for 30 minutes.

The test results are shown in Table 1.

Comparative Example 7

The same procedures as described in Example 1 were carried out except that, in the preparation of each of the aqueous dye-precursor and color developing dispersions, the pulverizing glass beads with the diameter of 0.6 mm were replaced by pulverizing glass beads with a diameter of 1.2 mm, the temperature of the cooling water for the sand mill was changed from 5° C. to 20° C. and the temperature of the outlet portion of the sand mill was controlled to a level of 40° C. to 45° C.

The test results are shown in Table 1.

TABLE 1

| | Item | | | | | | | | | | |
|---|---|---|---|---|---|---|---|---|---|---|---|
| | Aqueous dye-precursor dispersion | | | | Aqueous color developer dispersion | | | | | | |
| | Pulverizing bead | | Discharging temperature of | Average particle | Pulverizing bead | | Discharging temperature of | Average particle | Recording sensitivity | | Whiteness of |
| Example No. | Type | Diameter (mm) | dispersion (°C.) | size (μm) | Type | Diameter (mm) | dispersion (°C.) | size (μm) | 0.24 m/J | 0.39 m/J | recording layer |
| Example | | | | | | | | | | | |
| 1 | Glass | 0.6 | 20–25 | 0.50 | Glass | 0.6 | 20–25 | 0.55 | 1.03 | 1.35 | 75 |
| 2 | " | 1.2 | 20–25 | 1.15 | " | 0.6 | 20–25 | 0.55 | 0.87 | 1.26 | 81 |
| 3 | " | 0.6 | 20–25 | 0.50 | " | 1.2 | 20–25 | 1.60 | 0.84 | 1.25 | 83 |
| 4 | Zirconia | 0.6 | 20–25 | 0.45 | Zirconia | 0.6 | 20–25 | 0.50 | 1.08 | 1.36 | 73 |
| 5 | Glass(*)$_1$ | 0.6 | 20–25 | 0.55 | Glass(*)$_1$ | 0.6 | 20–25 | 0.60 | 0.99 | 1.31 | 76 |
| 6 | Glass | 1.2<br>0.6 | 20–25 | 0.57 | Glass | 1.2<br>0.6 | 20–25 | 0.60 | 0.98 | 1.22 | 82 |
| 7 | " | 0.6<br>1.2 | 20–25 | 0.63 | " | 0.6<br>1.2 | 20–25 | 0.65 | 0.91 | 1.20 | 81 |
| 8 | " | 0.6 | 40–45 | 0.55 | " | 0.6 | 40–45 | 0.55 | 1.01 | 1.34 | 84 |
| Comparative Example | | | | | | | | | | | |
| 1 | Glass | 1.2 | 20–25 | 1.10 | Glass | 1.2 | 20–25 | 1.30 | 0.74 | 1.13 | 79 |
| 2 | " | 1.2(*)$_2$ | 20–25 | 1.00 | " | 1.2(*)$_2$ | 20–25 | 1.20 | 0.77 | 1.15 | 68 |
| 3 | Zirconia | 1.2 | 20–25 | 1.05 | Zirconia | 1.2 | 20–25 | 1.20 | 0.78 | 1.19 | 78 |
| 4 | Glass(*)$_1$ | 1.2 | 20–25 | 1.15 | Glass(*)$_1$ | 1.2 | 20–25 | 1.35 | 0.69 | 1.07 | 80 |
| 5 | Glass | 1.2<br>1.5 | 20–25 | 1.31 | Glass | 1.2<br>1.5 | 20–25 | 1.42 | 0.62 | 0.98 | 82 |
| 6 | " | 1.5<br>1.2 | 20–25 | 1.05 | " | 1.5<br>1.2 | 20–25 | 1.24 | 0.64 | 0.99 | 80 |
| 7 | " | 1.2 | 40–45 | 1.12 | " | 1.2 | 40–45 | 1.35 | 0.72 | 1.11 | 85 |

Note: (*)$_1$ . . . Vertical sand mill used instead of horizontal sand mill.
(*)$_2$ . . . Dispersing operation time was 120 minutes instead of 60 minutes.

We claim:

1. A process for producing a heat-sensitive recording material, comprising the steps of:

dispersing at least one substantially colorless electron-donating dye-precursor in water to prepare an aqueous dye-precursor dispersion;

separately dispersing at least one electron-accepting compound capable of a contact-reaction with and color development of the dye-precursor when heated, in water to provide an aqueous color-developer dispersion;

preparing a coating liquid by mixing together the aqueous dye-precursor dispersion, the aqueous color-developer dispersion and a resinous binder;

coating at least one surface of a sheet substrate with the coating liquid; and solidifying the resultant coating liquid layer to form a heat-sensitive recording layer on the sheet substrate, wherein at least one member of the dye-precursor and the color developer is finely pulverized into fine particles having an average particle size of 0.7 μm or less, the pulverizing medium comprising at least one member selected from the group consisting of glass beads, zirconia beads, alumina beads, silica beads, ceramic beads, steel beads and titanium beads, by a first dispersing operation using a first pulverizing medium consisting of a number of solid grains having a diameter of 1.0 mm or more, and then a second dispersing operation using a second pulverizing medium consisting of a number of solid grains having a diameter of 0.9 mm or less.

2. The process as claimed in claim 1, wherein the solid grains of the pulverizing medium have a specific gravity of 2 to 7 g/cm$^3$.

3. The process as claimed in claim 1, wherein the dispersing operations for the dye-precursor and the color developer are carried out by using one of a sand grinder, atomizer and ball mill.

4. The process as claimed in claim 1, wherein the finely pulverized dye-precursor or color developer particles have a particle size of from 0.05 to 2.0 μm.

5. The process as claimed in claim 1, wherein the finely pulverized dye-precursor or color developer particles have a fraction thereof consisting of particles having a size of 1 μm or less, and in an amount of 70% or more based on the total weight of all of the particles.

6. The process as claimed in claim 1, wherein the resultant finely pulverized particles have a fraction thereof consisting of particles having a size of 2 μm or more, in an amount of 10% or less, based on the total weight of all of the particles.

7. The process as claimed in claim 1, wherein the dye-precursor dispersion passed through the dispersing operation, using the second pulverizing medium consisting of a number of the solid particles having the diameter of 0.9 mm or less and the first dispersing operation using the pulverizing medium consisting of a number of the solid particles having the diameter of 1.0 mm or more, is discharged from the dispersing step at a temperature of 30° C. to 60° C.

* * * * *